US005921413A

United States Patent [19]

Knight et al.

[11] Patent Number: 5,921,413

[45] Date of Patent: Jul. 13, 1999

[54] MERCHANDISE DISPLAY APPARATUS

[75] Inventors: Angela U. Knight, Rural Hall; John P. Oberholtzer, Greensboro, both of N.C.

[73] Assignee: Sara Lee Corporation, Winston-Salem, N.C.

[21] Appl. No.: 08/828,800

[22] Filed: Mar. 27, 1997

[51] Int. Cl.[6] ..... A47F 5/00

[52] U.S. Cl. ..... 211/169; 211/163; 40/538

[58] Field of Search ..... 211/163, 169; 248/205.2; 40/124.01, 299.01, 538, 124, 622; 206/457, 458, 459.1, 459.5

[56] References Cited

U.S. PATENT DOCUMENTS

| | | | |
|---|---|---|---|
| 1,049,886 | 1/1913 | Manson | 211/169 X |
| 2,923,417 | 2/1960 | Sonksen | 211/169 X |
| 2,950,155 | 8/1960 | Schick | 211/163 X |
| 3,181,706 | 5/1965 | Mandel | 211/163 |
| 4,654,988 | 4/1987 | Ericksen | 40/124.01 |
| 4,735,290 | 4/1988 | Byrley | 40/124.2 X |
| 4,951,826 | 8/1990 | Tompkins | 211/40 |
| 5,671,849 | 9/1997 | Bacon | 248/205.2 X |

*Primary Examiner*—Robert W. Gibson. Jr.

*Attorney, Agent, or Firm*—Charles W. Calkins; Kilpatrick Stockton LLP

[57] ABSTRACT

A merchandise display apparatus which permits the full line of inventory to be displayed to customers while minimizing the space needed to display the goods and simplifying the process of purchasing a selected item. The merchandise display apparatus includes a display stand having a vertical support member about which a plurality of display panels are rotatably attached for a consumer to "flip" through the panels while browsing for goods. A plurality of small, display cut-out articles or tokens comprising a three-dimensional representation of the actual item are removably attached to the display panels surfaces such that a consumer selecting the item represented by the display article may remove the display article from a panel and present it to a sales clerk.

31 Claims, 5 Drawing Sheets

MERCHANDISE DISPLAY APPARATUS

BACKGROUND OF THE INVENTION

1. Field of the Invention

The subject invention is generally related to equipment for use in the retail sales industry and is specifically directed to a display apparatus for displaying consumer goods, such as articles of clothing, for sale in a retail environment.

2. Description of the Related Art

In the retail sales industry, it is common to display goods for sale using a sales display, sales rack or similar device for displaying the goods to customers. For example, in the retail clothing industry, inventory is typically displayed using clothing racks such as straight racks for use against a wall or circular racks for hanging clothes on a showroom floor. Each item of inventory is hung on a rack for the customer to inspect while browsing the showroom floor.

One problem with the typical method of displaying consumer goods is that, in order to show the customer the full number and variety of items available, each item of inventory must be stocked on the showroom floor, which decreases the available showroom space for other items. For items such as printed or logo t-shirts which are relatively bulky compared to their cost and compared to the profit margins associated with them, this means that a large amount of valuable showroom space must be occupied with a correspondingly lower profit return per square foot of space. Also, there may be a large variety of t-shirts with different printed designs, such as sports-team logos, to be displayed which further occupies valuable showroom space.

One solution to displaying available merchandise while minimizing the space needed to display the merchandise is to provide one sample of the merchandise on the showroom floor while keeping the remaining inventory in the storeroom. For example, t-shirts have been pinned to pieces of cardboard so that the printed design on the t-shirt is clearly displayed. The mounted t-shirt is then hung on a wall or placed on a display rack and is non-removable from either one. One problem with this solution is that the display samples of actual t-shirts still occupy a large amount of showroom space, particularly where there is a large number of different printed designs to be displayed.

Further, while customers can view the t-shirt design and make a selection, another problem with this method is that the customer must find a salesperson, lead them to the display wall or rack and show the salesperson which t-shirt they have selected. Alternatively, if the display t-shirt has been given a visible designation, such as a number, the customer must remember or write down the designation in order to relay the number to the salesperson and purchase the shirt. This may be inconvenient where a variety of shirts have been selected and many numbers must be remembered. Moreover, when the t-shirt is no longer in stock, the customer may unknowingly select an unavailable t-shirt based on the fact that the display sample is still on display and become frustrated. Thus, in order to avoid this problem, the salesperson must remember to remove the display sample or indicate that it is no longer in stock directly on the display sample.

Therefore, there is a need in the art for a device for displaying consumer goods wherein the actual goods need not be stocked on the showroom floor, yet the full line of inventory can be displayed to the customers, and customers can browse through various styles and kinds of goods and easily select and purchase their selection.

SUMMARY OF THE INVENTION

The subject invention is directed to a merchandise display apparatus which permits the full line of inventory to be displayed to customers while minimizing the space needed to display the goods and simplifying the process of purchasing a selected item. The merchandise display apparatus of the subject invention includes a display stand and a plurality of small display cut-out articles or tokens comprising a three-dimensional representation of the merchandise item.

The present invention provides a display rack having a vertical support member about which a plurality of vertical panels are rotatably attached in such a manner that a consumer may "flip" through the panels while browsing for goods. The front and back side of the panels include an attachment means for removably attaching the display articles. The articles which are small, three-dimensional representations of the actual merchandise items, are removably attached to the display panels, such that a consumer selecting the item represented by the display article may remove the display article from a panel and take it to a sales clerk. Referring to the display article, it may include stock number or other information for use by the sales clerk. The sales clerk then retrieves the appropriate item of merchandise from the stock of inventory, which may be kept in a cabinet or in a storage room.

In the preferred embodiment, the display token comprises a substantially flat piece of plastic which is cut or molded into the shape of the item of merchandise being sold. For example, when using the display of the present invention to display T-shirts, the display tokens are preferably formed in the general outline of a T-shirt. The display article or token is preferably provided with a design which is identical to the design of the actual item of inventory which it represents. Thus, the display token preferably resembles a miniature replica of the item of merchandise which it represents and is sized to be easily attached to the display panel. In the preferred embodiment, the number and type of display articles on the display panels is equal to the number and type of actual items in stock. Thus, a consumer would not unknowingly select an item which is no longer in stock.

Therefore, it is an object and feature of the subject invention to provide an apparatus for displaying consumer goods wherein the actual goods need not be stocked on the showroom floor, yet the full line of inventory can be displayed to the customers, and the customers can browse through various styles and kinds of goods.

It is a further object of the present invention to provide an apparatus including a display stand and display articles or tokens removably attached thereto for displaying consumer goods which occupies a modest amount of showroom space yet which permits a merchant to display a large number of types and styles of goods.

It is another object and feature of the subject invention to provide a method for displaying and selling merchandise to consumers without displaying and occupying showroom space with the actual merchandise items.

The foregoing and other features, aspects, and advantages of the present invention will become better understood with regard to the following description, appended claims, and accompanying drawings.

DETAILED DESCRIPTION OF THE PREFERRED EMBODIMENT

Figure 1:
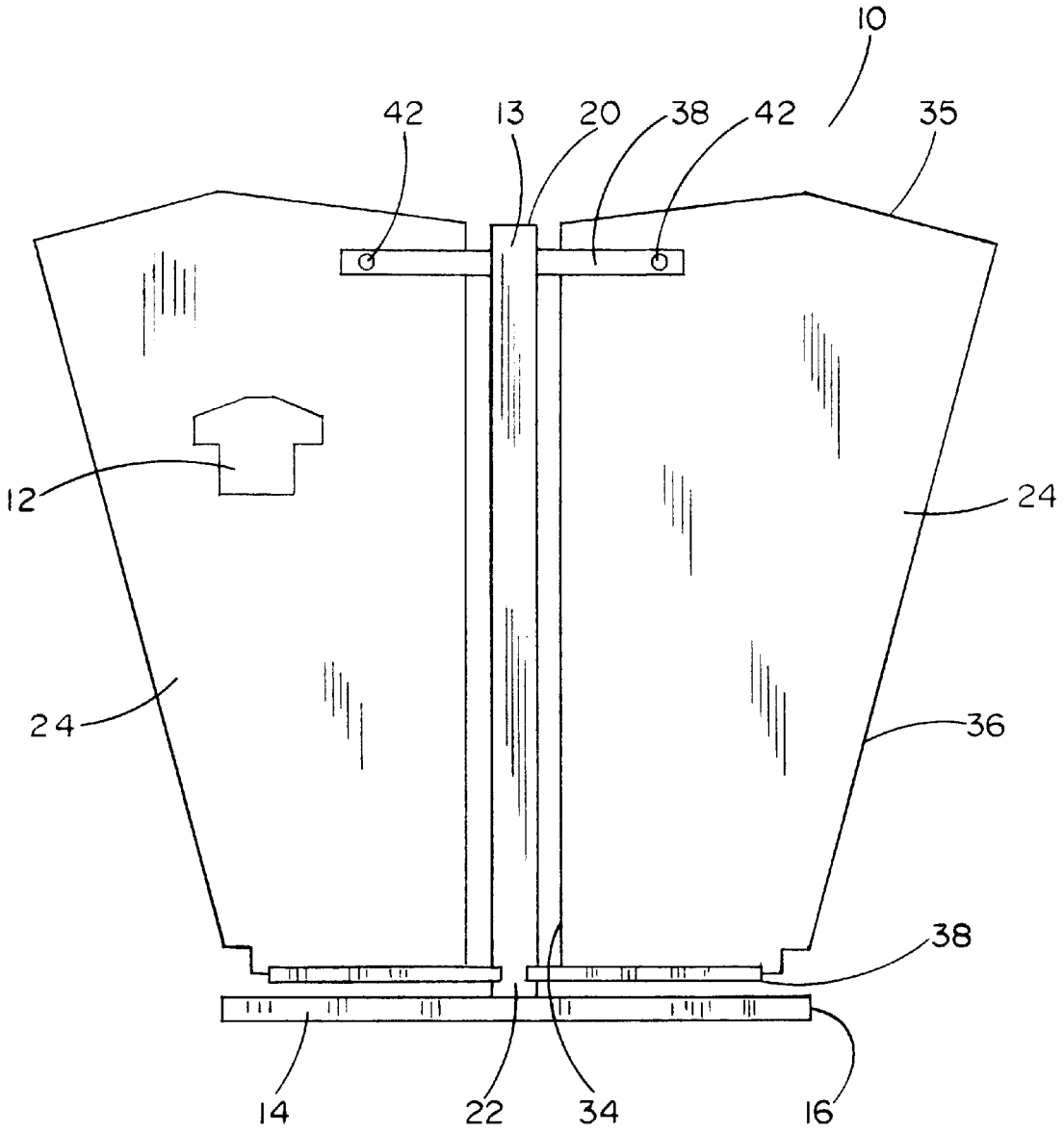
FIG. 1 is a perspective view of an embodiment of a merchandise display apparatus of the present invention.
Figures 2A, 2B, 2C:
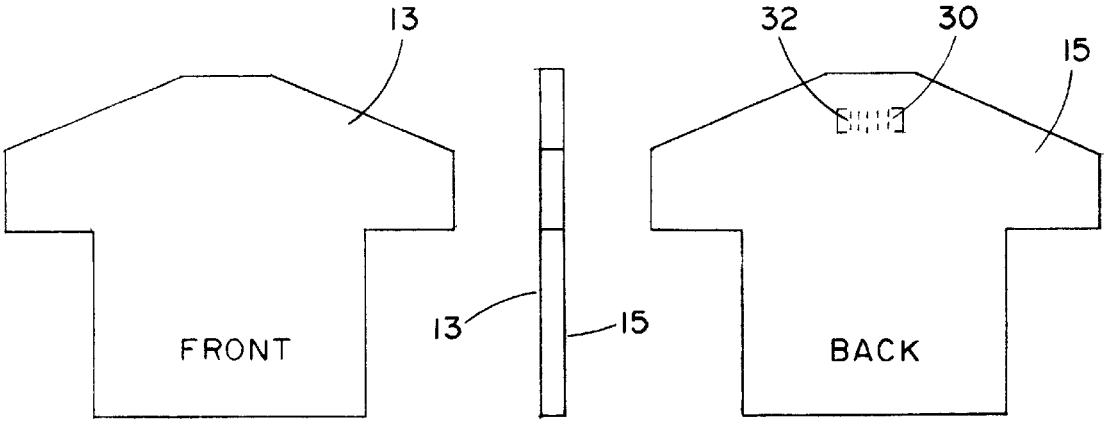
FIGS. 2*a*, 2*b* and 2*c*, 2*d* depict embodiments of a display article of the present invention formed in the shape of a t-shirt, in front, side and back views.
Figure 2D:
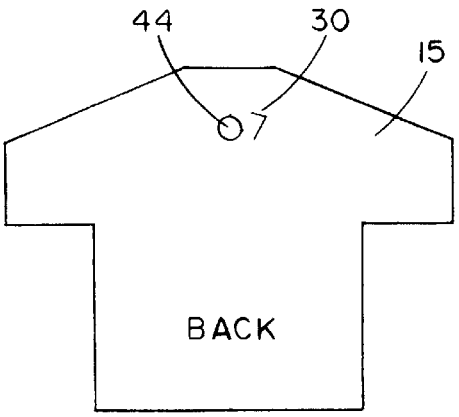
Figures 3A, 3B, 3C:
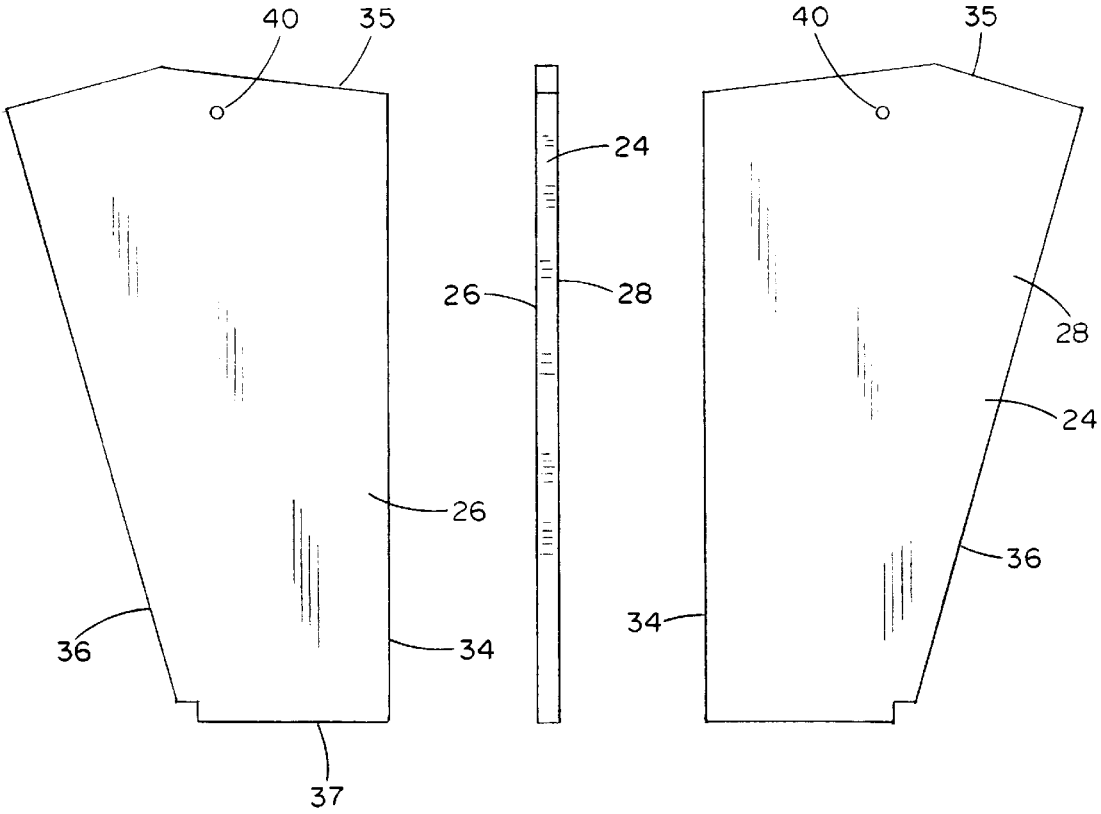
FIGS. 3*a*, 3*b*, 3*c* and 3*d* depict embodiments of a display surface of the present invention in front, side and back views.
Figure 3D:
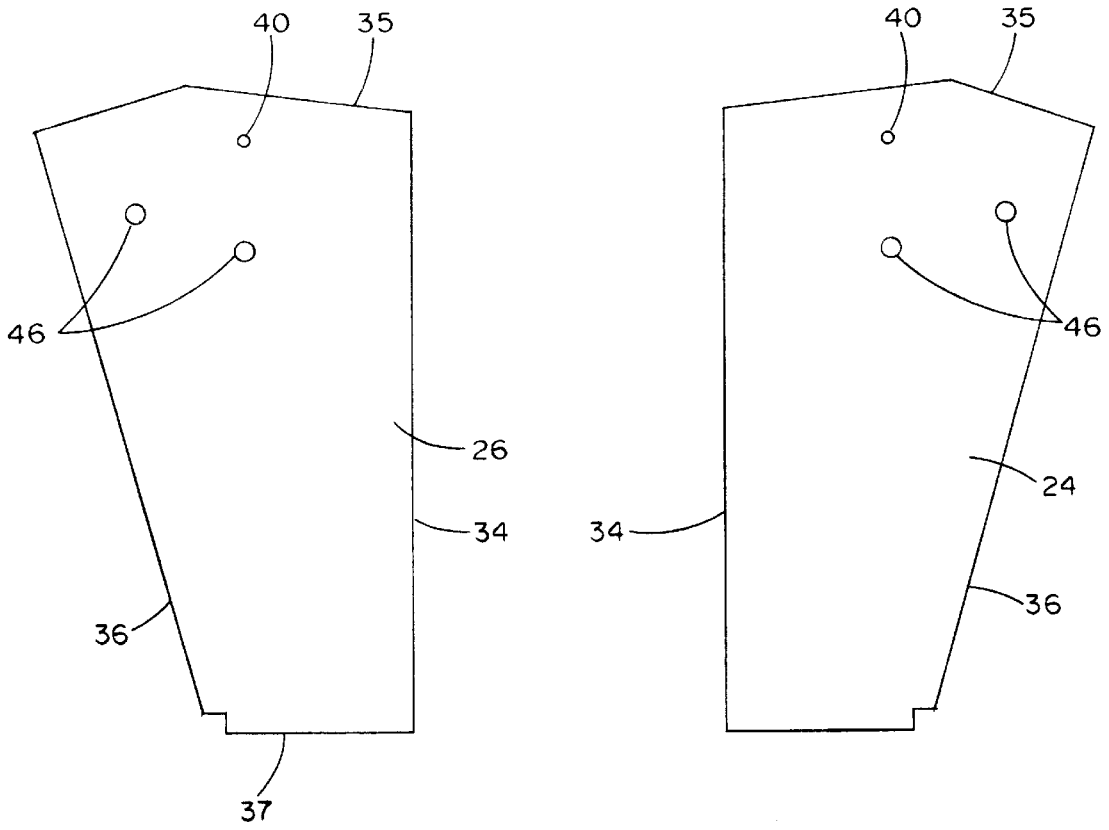

The subject invention is shown in FIGS. 1–3 and is directed to a merchandise display apparatus designated generally by the numeral 10. The merchandise display apparatus 10 of the subject invention is designed to permit a full line of inventory to be displayed to customers while minimizing the amount of showroom space occupied by the display. The subject invention is specifically directed to a display apparatus 10 which utilizes display articles or tokens 12 to display the merchandise so that consumers may browse through various styles and kinds of goods without displaying the actual merchandise. Thus, the actual goods need not be stocked on the showroom floor and valuable space is saved.

Referring now to the drawings and first to FIG. 1, it will be understood that the apparatus of the present invention comprises a display stand 14 having a base portion 16 and a vertical support member 18 extending vertically from the top of the base portion 16. The vertical support member 18 has a top end 20 and a bottom end 22 which is secured in the base portion 16. The vertical support member 18 is preferably rotatable about its vertical axis by means of a carousel or bearing disposed between the bottom end 22 of the support member 18 and the base portion 16.

The display stand 14 includes a plurality of display surfaces on which the plurality of cut-out articles or tokens 12 are removably mounted. Each article 12 comprises a three-dimensional representation of a merchandise item and is constructed of a lightweight, durable material. In the preferred embodiment, the material is a rigid plastic, such as by way of example, an acrylic laminate. As shown in FIG. 2, each article 12 is shaped substantially similar to a general outline of the actual merchandise item which it represents, such as by way of example, a t-shirt. Each article 12 is small, easily carried, reusable and is sized such that a plurality of articles fits on each display surface. For example, the dimensions of the typical t-shirt shaped article 12 shown in FIG. 2 are 4 inches in width, 3 inches in length, and ¼ inches in thickness.

In the preferred embodiment, the article 12, has a front surface 13 and a back surface 15. The front and back surfaces 13, 15 of the article 12 are substantially flat for easily mounting the articles 12 on the display surfaces. As shown in FIGS. 1–3, the front surface 13 is positioned to face outward from the display stand for viewing by the consumer and includes an identical depiction of the design on the actual merchandise item. Each article 12 may be provided with a backing or attachment means 30 on its back surface 15 for removably attaching the article 12 to the display stand 14.

The plurality of display surfaces of the display stand 14 comprise a plurality of display panels 24, each having a front side 26 and a back side 28. Both of the front and back sides 26, 28 of the display panels have a surface adapted for receiving the attachment means 30 on the back surface of each article 12 for removably securing the articles 12 to the front and back sides 26, 28 of the display panels 24. In the preferred embodiment, the front and back sides 26, 28 of the panels 24 are provided with a covering, such as a felt material which is adapted to receive and hold a hook-and-loop type fastener, such as a Velcro™ strip. The attachment means 30 on the back surface 15 of each article 12 is a complementary hook-and-loop type fastener. Thus, the attachment means 30 is a backing strip including a plurality of tiny hooks 32, such as, by way of example, the hooked portion of a Velcro™ strip. In use, the hooks 32 engage the felt material and removably attach the articles 12 to the panels 24. Further, both sides 26, 28 of the panels may be covered with a Velcro™ hook or loop material and the back surface 15 of the article 12 may include the complementary hook or loop material for removably securing the articles 12. Alternatively, the back surface 15 of each article 12 may include a small hole and bolt receptacle 44 and both sides 26, 28 of the panels 24 include a bolt receptacle 46 for receiving a bolt on the articles for securing the articles to the panels. The vertical panel is provided with a covering such as hook and loop sensitive material which is adapted to receive and hold a velcro™ strip. In addition, other means of attaching the articles 12 to the vertical panels 24 may obviously be employed without departing from the spirit or scope of the invention.

The vertical support member 18 is adapted to rotatably support the display panels 24 such that consumers may turn the panels 24 to view articles 12 removably secured to the front and back sides 26, 28 of the panels 24. The panels 24 are vertical and have inner and outer edges 34, 36 and top and bottom ends 35 and 37. The panels 24 are attached to the vertical member 18 along the inner edges 34 of the vertical panels 24. In the preferred embodiment, the vertical support member 18 includes a plurality of arms 38 extending outward from the top and bottom ends 20, 22 of the member 18. The arms may include a bolt receptacle 42 for receiving a bolt or other fastening means to fasten the panels to the vertical support members. The arms 38 are secured to the panels 24 at the top and bottom ends 35, 37 of each panel 24. The arms 38 may be stationary or rotatable relative to the vertical support member 18. When the arms 38 are secured to the panels 24, the vertical panels 24 are preferably pivotable in a plane normal to the vertical axis of the vertical support member 18, such that a consumer browsing through the display can "flip" from panel to panel. As shown in FIG. 1, the vertical panels 24 preferably taper from top end 35 to bottom end 37 such that they are widest at the top and narrowest near the base portion 16. As shown in FIG. 3, the panels 24 may include a receptacle 40 for receiving a bolt or other fastening means to fasten the panels to the vertical support members.

Figure 4:
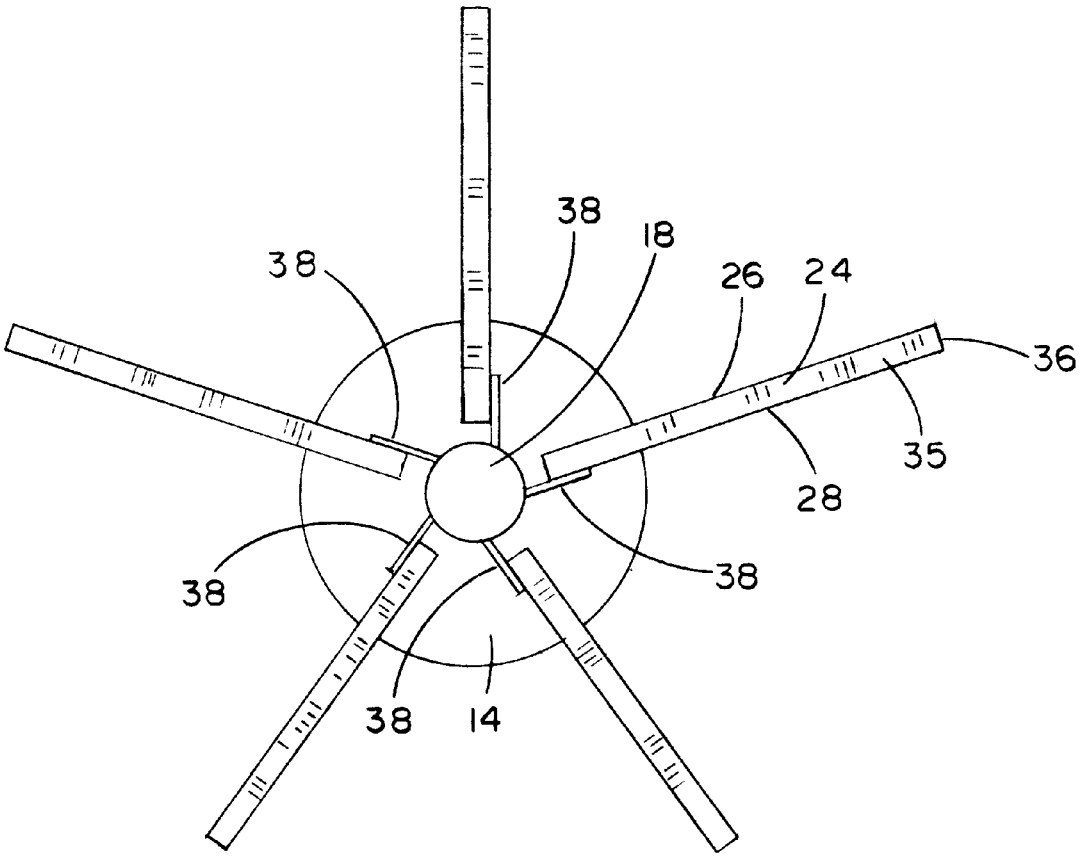
FIG. 4 depicts a top perspective view of the embodiment shown in FIG. 1.

FIG. 4 depicts a top perspective view of the embodiment shown in FIG. 1. As shown in FIG. 4, the display apparatus, 10, may include a plurality of display surfaces.

While specific embodiments and features of the invention have been disclosed herein, it will be readily understood that the invention encompasses all enhancements and modifications within the scope and spirit of the following claims.

What is claimed is:

1. A display apparatus for displaying merchandise for selection by customers without displaying the actual merchandise items for minimizing space needed to display merchandise, said display apparatus comprising:

a. a display stand having a plurality of display surfaces; and b. a plurality of cut-out articles removably mounted on said display surfaces, each article comprising a three-dimensional representation of a merchandise item.

2. The display apparatus of claim 1, wherein said article is shaped substantially similar to a general outline of the actual merchandise item.

3. The display apparatus of claim 2, wherein said article is constructed of a lightweight, durable material and is easily transportable.

4. The display apparatus of claim 3, wherein said article is sized such that a plurality of articles fits on each display surface.

5. The display apparatus of claim 4, each article further having a front and a back surface, said surfaces being substantially flat and said front surface including a depiction of the design on the actual merchandise item and facing outward from the display stand for viewing by customers.

6. The display apparatus of claim 5, wherein said back surface includes an attachment means for securing said article to the display surface.

7. The display apparatus of claim 6, wherein said lightweight, durable material is plastic.

8. The display apparatus of claim 7, wherein said material is an acrylic laminate.

9. The display apparatus of claim 1, wherein said display surfaces comprise a plurality of display panels, each panel having a front side and a back side.

10. The display apparatus of claim 9, said front and back sides of said display panels having a surface adapted for receiving the attachment means on the back surface of said articles for removably securing said articles to the panels.

11. The display apparatus of claim 10, wherein said front and back sides of said panels are covered with a hook and loop sensitive material.

12. The display apparatus of claim 11, wherein said attachment means on the back surface of the articles is a backing strip including a hook-type fastener having a plurality of tiny hooks.

13. The display apparatus of claim 10, wherein said front and back sides of said panels and said attachment means on the back surface of the articles comprises a hook-and-loop type fastener with complementary, mated fastener materials on the front and back sides of each panel and on said back surface of each article, respectively.

14. The display apparatus of claim 10, wherein said back surface of each article includes a bolt receptacle and said front and back sides of said display panels include a bolt receptacle for receiving a bolt on said articles for securing said articles to said panels.

15. The display apparatus of claim 10, said display stand further comprising a base and a vertical support member having a top end and a bottom end, said vertical support member being mounted on said base and adapted to rotatably support said display panels whereby customers may flip panels to view articles on both front and back sides of said display panels.

16. The display apparatus of claim 15, said vertical support member further comprising a plurality of arms extending outward from said top and bottom ends of said support member, said arms being securely attached to said panels for rotatably securing said panels to said vertical support member.

17. The display apparatus of claim 16, wherein said arms are attached to said top end and bottom end of each panel and said panels revolve around said vertical support member whereby customers may turn panels to view articles on both front and back sides of said panels.

18. The display apparatus of claim 17, wherein said arms are rotatable relative to said vertical support member for turning said panels to view articles on both sides of said panels.

19. The viewing system of claim 17, wherein said panels are wedge-shaped being wider at the top end and narrower at the bottom end near the base.

20. The viewing system of claim 10, wherein said articles are shaped to be a general outline of an item being sold.

21. The viewing system of claim 20, wherein said articles include depictions of a plurality of different article designs for selection by customers.

22. A method for displaying and selling merchandise to customers on a display rack having a vertical central support member and a plurality of display boards rotatably attached to the vertical support member, the steps comprising:

a. providing a plurality of removably mountable articles, said articles being three-dimensional representations of actual merchandise items and including a depiction of the design on the actual merchandise item;

b. placing said articles on the plurality of display boards of the display rack, wherein said articles are facing outward from the display boards for viewing by customers; and c. flipping the display boards to display articles removably mounted on both sides of the boards.

23. The method of claim 22, wherein said boards have front and back sides and both sides include a surface adapted for attaching said articles thereto.

24. The method of claim 23, wherein said boards are covered with hook and loop sensitive materials and said articles include a strip of velcro for removably mounting said articles to said boards.

25. The method of claim 23, a step further comprising selecting and removing at least one article from the display boards.

26. The method of claim 25, a step further comprising presenting the removed article to merchant and obtaining actual, merchandise represented by article and depicted thereon.

27. A display apparatus for displaying merchandise for selection by customers without displaying the actual merchandise items for minimizing space needed to display merchandise, said display apparatus comprising:

a. a display stand having a plurality of display surfaces;

b. said display surfaces comprising a plurality of display panels, each panel having a front side and a back side;

c. a plurality of cut-out articles removably mounted on said display surfaces, each article comprising a three-dimensional representation of a merchandise item;

d. each of said articles having a front and a back surface;

e. said back surface of said articles including an attachment means for securing said articles to the display surface;

f. said front and back sides of said display panels having a surface adapted for receiving the attachment means on the back surface of said articles for removably securing said articles to the panels;

g. said display stand further comprising a base and a vertical support member having a top end and a bottom end, said vertical support member being mounted on said base and adapted to rotatably support said display panels whereby customers may flip panels to view articles on both front and back sides of said display panels.

28. The display apparatus of claim 27, said vertical support member further comprising a plurality of arms extending outward from said top and bottom ends of said support member, said arms being securely attached to said panels for rotatably securing said panels to said vertical support member.

29. The display apparatus of claim 28, wherein said arms are attached to said top end and bottom end of each panel and said panels revolve around said vertical support member whereby customers may turn panels to view articles on both front and back sides of said panels.

30. The display apparatus of claim 29, wherein said arms are rotatable relative to said vertical support member for turning said panels to view articles on both sides of said panels.

31. The display apparatus of claim 29, wherein said panels are wedge-shaped being wider at the top end and narrower at the bottom end near the base.

* * * * *